US006739254B2

(12) United States Patent
Frankenberger et al.

(10) Patent No.: US 6,739,254 B2
(45) Date of Patent: May 25, 2004

(54) SUPPORTING OR GUIDING DEVICE FOR SHEETS IN A SHEET PROCESSING MACHINE, PARTICULARLY A PRINTING PRESS

(75) Inventors: Eckart Frankenberger, Hamburg (DE); Peter Hachmann, Dossenheim (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/396,842

(22) Filed: Mar. 25, 2003

(65) Prior Publication Data

US 2003/0178765 A1 Sep. 25, 2003

(30) Foreign Application Priority Data

Mar. 25, 2002 (DE) ..... 102 13 325

(51) Int. Cl.[7] ..... B41F 13/24

(52) U.S. Cl. ..... 101/232; 271/195; 271/211; 101/419

(58) Field of Search ..... 101/231, 232, 101/4, 6.1, 419; 271/195, 211; 406/77, 79, 88

(56) References Cited

U.S. PATENT DOCUMENTS 4,225,129 A * 9/1980 Zimmermann et al. ..... 271/204
4,688,784 A * 8/1987 Wirz ..... 271/195
5,222,726 A * 6/1993 Vits ..... 271/195
5,505,124 A 4/1996 Esposito
5,927,203 A * 7/1999 Gieser et al. ..... 101/419
6,612,235 B2 * 9/2003 Frankenberger et al. .... 101/231
6,659,446 B2 * 12/2003 Fischer et al. ..... 271/97

FOREIGN PATENT DOCUMENTS

DE 44 06 739 C2 9/1995
WO 01/14752 A1 3/2001

* cited by examiner

*Primary Examiner*—Ren Yan
(74) *Attorney, Agent, or Firm*—Laurence A. Greenberg; Werner H. Stemer; Ralph E. Locher

(57) ABSTRACT

A supporting or guiding device for sheets in a sheet processing machine includes a supporting or guiding layer having a supporting or guiding surface formed with a plurality of outlet openings for applying a throttled air flow therethrough to a respective sheet. A covering plate is spaced away from the supporting or guiding surface, and at least two intermediate layers are formed with a plurality of openings and disposed between the supporting or guiding surface and the covering plate. The covering plate is connected via a plurality of inlet openings to at least one blast air source. A respective opening formed in one of the intermediate layers is connected to two respective openings formed in the other of the intermediate layers, and an opening formed in the other intermediate layer is connected to two respective openings formed in the one intermediate layer, between one of the respective inlet openings and one of the respective outlet openings associated therewith.

3 Claims, 5 Drawing Sheets

SUPPORTING OR GUIDING DEVICE FOR SHEETS IN A SHEET PROCESSING MACHINE, PARTICULARLY A PRINTING PRESS

BACKGROUND OF THE INVENTION

Field of the Invention

The invention relates to a supporting or guiding device for sheets in a sheet processing machine, particularly a printing press.

It has become known heretofore to provide pneumatically actuatable guide elements for producing an air cushion between respective sheets and guide elements, for contact-free transport of sheets in printing presses. Such an air cushion prevents the respective sheets from coming into contact with the guide elements.

There are a great number of regions in the printing press wherein pneumatically actuated guiding devices are employed. Such regions are, for example supporting rods for sheets or sheet piles in the feeder or delivery, the upper side of the pregripper, separator shoes, guide elements in the pocket or wedge region of cylinders, smoothing and decurling devices, guide elements on the circumference of cylinders of the reversing or turning device or on the circumference of sheet transport cylinders, and so forth.

A method of generating throttled blast or blown air for supporting bodies is known from International Application No. WO 01/14752 A1, which corresponds to U.S. Pat. No. 6,523,572. In that method, a throttling or restricting segment or distance is provided between a blast or blown air outlet and a blast or blown air inlet. Therefore, a passageway for blast or blown air is formed in a plane between an outlet surface and a cover surface. The passageway has outer walls whereon ribs are disposed for producing swirling of the blast or blown air.

Such throttling or restricting segmentes or distances, however, can be produced only with a great deal of expenditure. Therefore, the cost/benefit ratio is economically disadvantageous.

German Patent DE 44 06 739 C2, which corresponds to U.S. Pat. No. 5,505,124, discloses the production of throttled negative pressure or vacuum for holding a flat element. In that regard, a throttle segment or distance for suction air is formed between a supporting surface facing towards the flat element and a throttling surface located at a distance therefrom. That is done by placing intermediate layers on top of one another, with apertures formed in the layers. In that regard, a plurality of small apertures in one intermediate layer are brought into coincidence with a respectively large aperture formed in another intermediate layer. In that configuration, a plurality of inlet openings are connected simultaneously to a plurality of outlet openings.

SUMMARY OF THE INVENTION

It is accordingly an object of the invention to provide a supporting or guiding device for bearing or guiding sheets in a sheet processing machine, in particular a printing press, which overcomes the hereinafore-mentioned disadvantages of the heretofore-known devices of this general type and with which throttled blast or blown air is made available.

With the foregoing and other objects in view, there is provided, in accordance with the invention, a supporting or guiding device for sheets in a sheet processing machine. The device comprises a first layer having a supporting or guiding surface formed with a plurality of outlet openings for applying a throttled air flow therethrough to a respective sheet. A covering plate is spaced away from the supporting or guiding surface. At least two intermediate layers, respectively formed with a plurality of openings, are disposed between the supporting or guiding surface and the covering plate. The covering plate is connected via a plurality of inlet openings to at least one blast air source. A respective opening formed in one of the intermediate layers is connected to two respective openings formed in the other of the intermediate layers, and an opening formed in the other intermediate layer is connected to two respective openings formed in the one intermediate layer, between one of the respective inlet openings and one of the respective outlet openings associated therewith.

In accordance with another feature of the invention, the supporting or guiding device further includes a further layer disposed between the one intermediate layer and the other intermediate layer.

In accordance with a further feature of the invention, the further layer is formed with openings disposed in a region of a throttle segment located between the respective inlet opening and the respective outlet opening.

In accordance with an added feature of the invention, the supporting or guiding device further includes yet a further intermediate layer, respectively disposed between the supporting and guiding surface and the one intermediate layer, and between the covering and the other intermediate layer.

In accordance with an additional feature of the invention, the further intermediate layers are respectively formed with openings disposed in a region of the throttle segment.

In accordance with yet another feature of the invention, in addition to the intermediate layers, there is provided a relatively large plurality of further intermediate layers.

With the objects of the invention in view, there is also provided a supporting or guiding device for sheets in a sheet processing machine. The device comprises a first layer having a supporting or guiding surface formed with a plurality of outlet openings for applying a throttled air flow therethrough to a respective sheet. A covering plate is spaced away from the supporting or guiding surface. At least two intermediate layers, respectively formed with a plurality of openings, are disposed between the supporting or guiding surface and the covering plate. The covering plate is connected via a plurality of inlet openings to at least one blast air source. A further layer is disposed between the at least two intermediate layers, between the respective inlet opening and the respective outlet opening associated therewith. The openings formed in one of the at least two intermediate layers is located opposite the openings formed in the other of the at least two intermediate layers, and respective lands between respective openings formed in the one intermediate layer are disposed opposite respective lands formed in the other intermediate layer.

In accordance with a further feature of the invention, the further layer has a greater thickness than the at least two intermediate layers.

In accordance with an added feature of the invention, the further layer is formed with openings respectively disposed in a region of the lands of the one intermediate layer and the lands of the other intermediate layer.

In accordance with an additional feature of the invention, the further layer is formed with openings having a smaller passthrough than the openings formed in the intermediate layers.

In accordance with a concomitant feature of the invention, the sheet processing machine is a printing press.

An advantage of the invention is, for one, the low overall height of the guiding or supporting device, and the cost-effective capability of producing the same. This is because the throttle segment can be formed simply of sheetmetal provided with a plurality of openings or apertures, which can be produced cost-effectively by simple punching or stamping.

It is furthermore beneficial, for example, to provide different paths for the blast or blown air within a throttle segment or section due to the disposition of a plurality of layers.

Other features which are considered as characteristic for the invention are set forth in the appended claims.

Although the invention is illustrated and described herein as embodied in a supporting or guiding device for sheets in a sheet processing machine, in particular a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
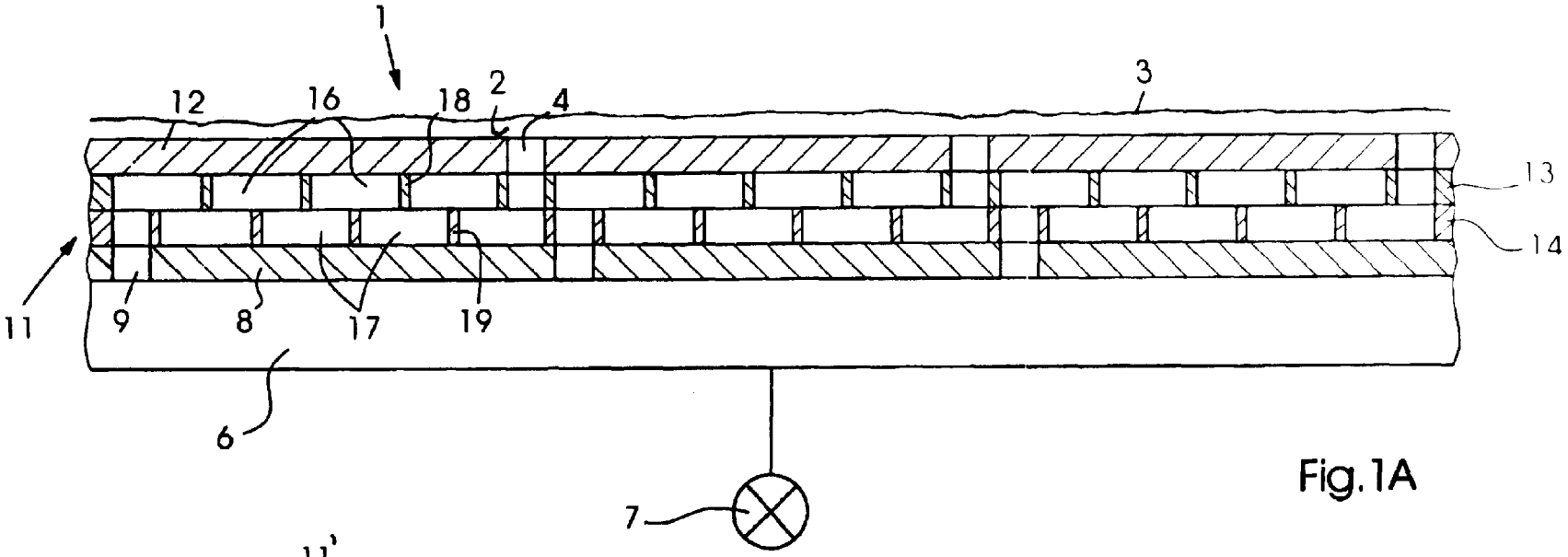
FIG. 1A is a fragmentary, diagrammatic, sectional view of a first embodiment of a supporting or guiding device according to the invention with a throttle segment or length.
Figure 1B:
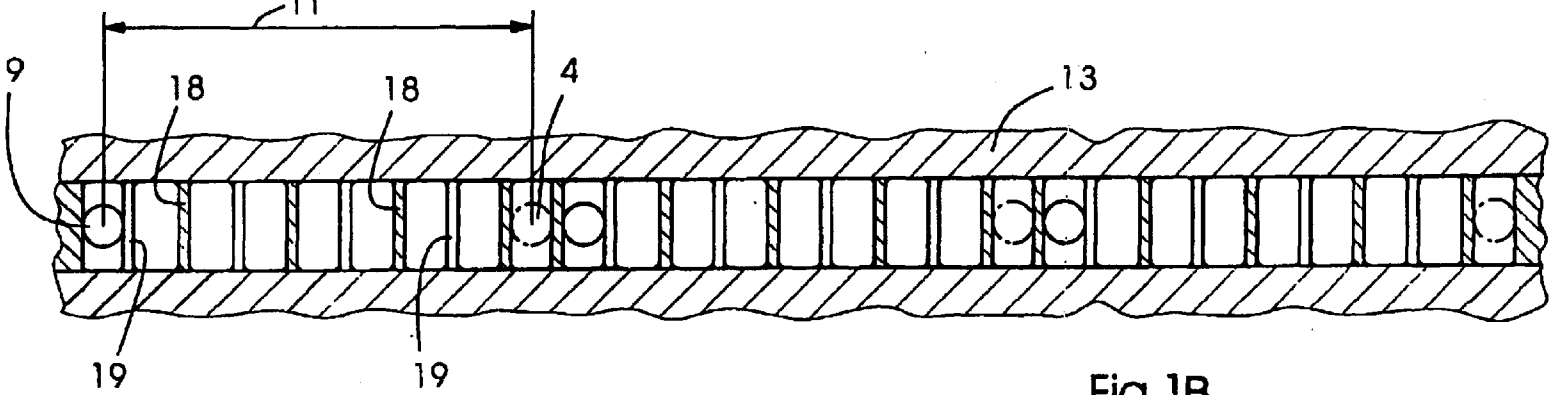
FIG. 1B is a top-plan view of FIG. 1A, showing a section through an upper layer of the throttle segment or length therein.

Referring now to the figures of the drawings in detail and first, particularly, to FIGS. 1A and 1B thereof, there is seen, in a sheet processing machine, for example a printing press, a first exemplary embodiment of a pneumatically actuated supporting or guiding device 1 provided with appropriate blast or blower openings or outlet openings 4 for ensuring the formation of an air cushion 2 between a sheet 3 and the guiding or supporting element 1. A pressure reservoir is formed as a pressure chamber 6 and connected to a compressed-air source 7. The pressure chamber 6 has a covering 8 provided with a number of inlet openings 9. Each opening 9 is connected via its own throttle or throttling segment, stretch or length 11' (note FIG. 1B) to the respective outlet opening 4 of a respective supporting or guiding surface 12 of a supporting or guiding layer.

In the first exemplary embodiment according to FIGS. 1A and 1B, the throttle segment 11' is formed by two layers 13 and 14. Each layer 13, 14 has a number of approximately equally sized openings or apertures 16 and 17 disposed behind one another and disposed on top of one another. In this way, a respective a ledge or land 18 between two openings or apertures 16 is located opposite a respective opening 17. Furthermore, a respective ledge or land 19 between the respective openings 17 of the layer 14 is located opposite a respective opening 16 in the layer 13. In this regard, the air flow passes through the openings 9 into the region of the opening 17 of the layer 14, from there onwardly into the opening 16 of the layer 13 and then back again into a further opening 17 of the layer 14. Air vortices are formed in the openings 16 and 17 between two ledges or lands 18—18 and 19—19, respectively, in this regard, which produce a flow resistance in the throttle segment 11' and therefore limit an air volume discharge at the outlet opening 4. In particular, when the openings 4 are not covered by a sheet, this measure results in an inability of an excessive amount of compressed air to emerge from the outlet openings 4, which prevents the pressure in the pressure chamber 6 from collapsing.

Figure 2:
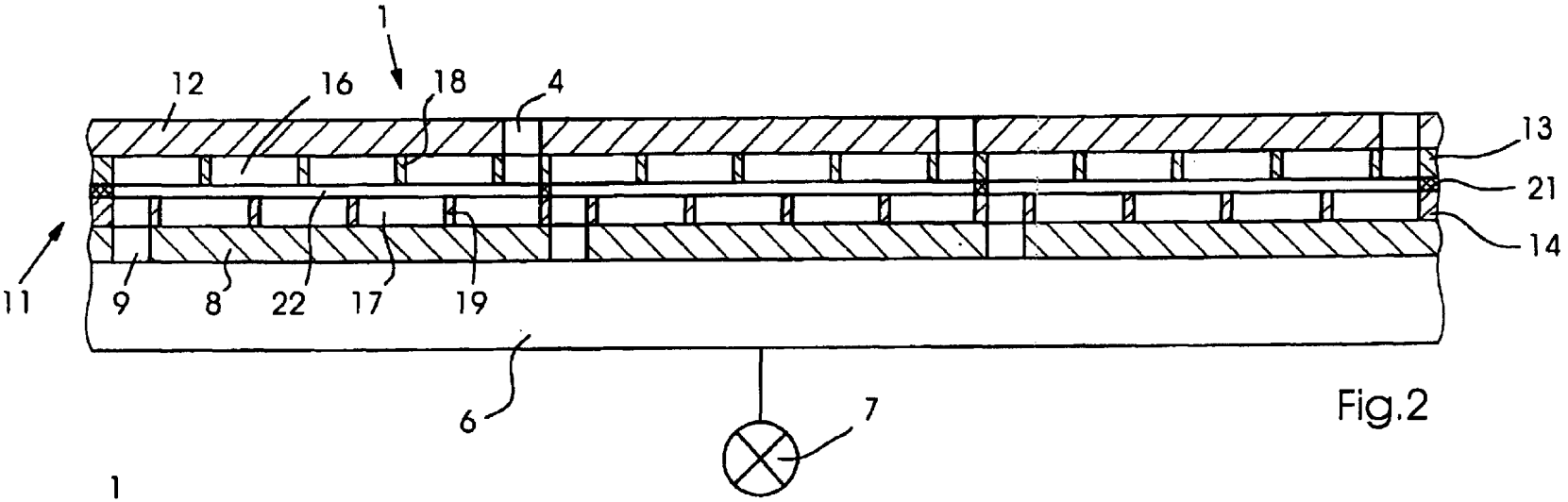
FIG. 2 is a view similar to FIG. 1A of a second exemplary embodiment of the supporting or guiding device according to the invention.

In a second exemplary embodiment according to FIG. 2, provision is made for a further or spacing layer 21 to be disposed between the layers 13 and 14 so that this throttle segment 11' has an opening 22 lying in the region of the throttle segment 11'. Through the use of this measure, a core passage is formed which ensures a portion of free, unhindered air flow.

Figure 3:
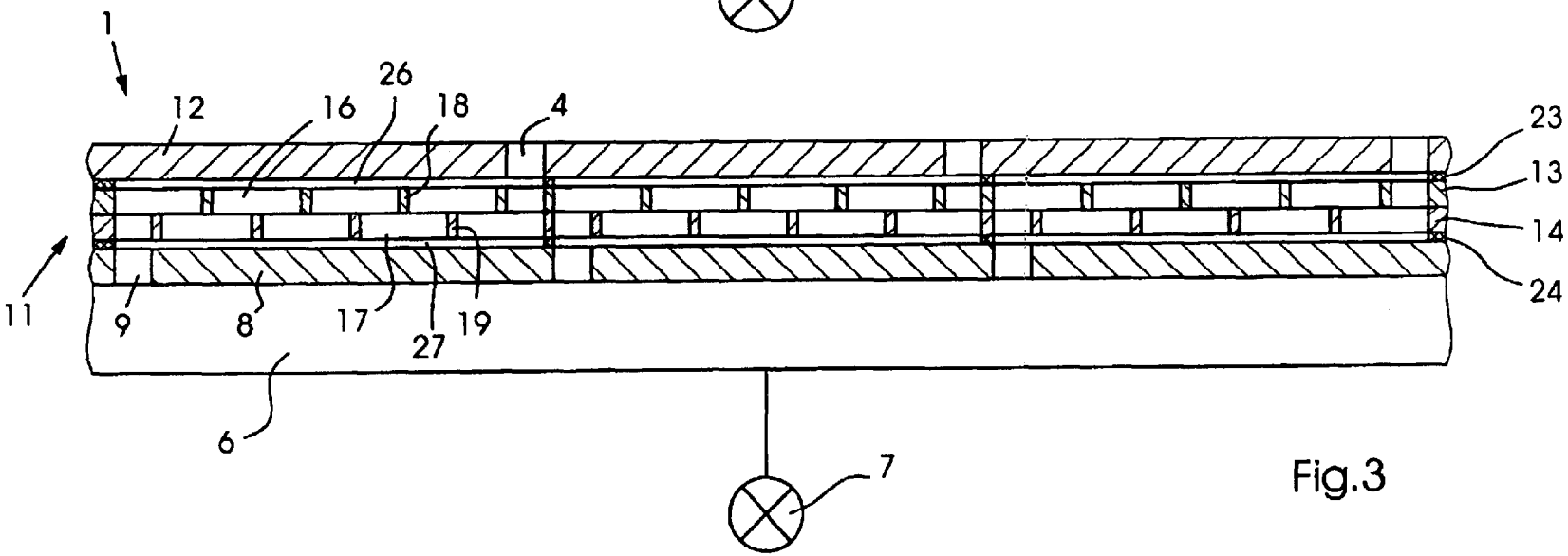
FIG. 3 is a view similar to FIGS. 1A and 2 of a third exemplary embodiment of the device according to the invention.

In a third exemplary embodiment according to FIG. 3, provision is made for two spacing layers 23 and 24, the first spacing layer 23 being disposed between the supporting or guiding surface 12 and the layer 13, and the second spacing layer 24 being disposed between the layer 14 and the covering 8. An opening 26 formed in the spacing layer 23, and an opening 27 formed in the spacing layer 24 are, respectively, located in the region of the throttle segment 11'. By this measure, two further paths between the layer 13 and the supporting or guiding surface 12, and between the layer 14 and the covering 8, are provided for the air flow on the way thereof through the layers 13 and 14.

Figure 4:
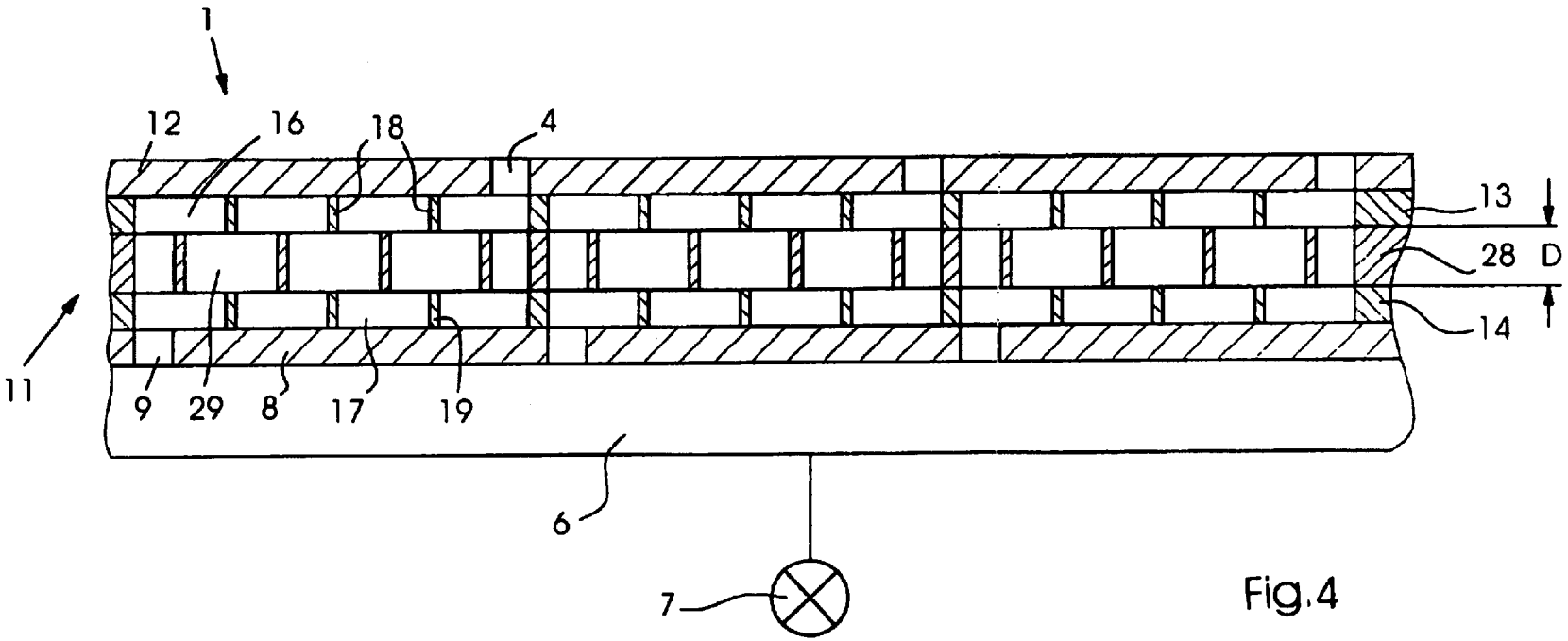
FIG. 4 is a view similar to FIGS. 1A, 2 and 3 of a fourth exemplary embodiment of the device according to the invention.

In a fourth exemplary embodiment according to FIG. 4, provision is made for a further or third layer 28 between the layers 13 and 14, the third layer 28 being formed with openings 29, and at least approximately corresponding in appearance to the layers 13 and 14, however, it being possible for the thickness D thereof to be greater than that of the layers 13 and 14.

Figure 5:
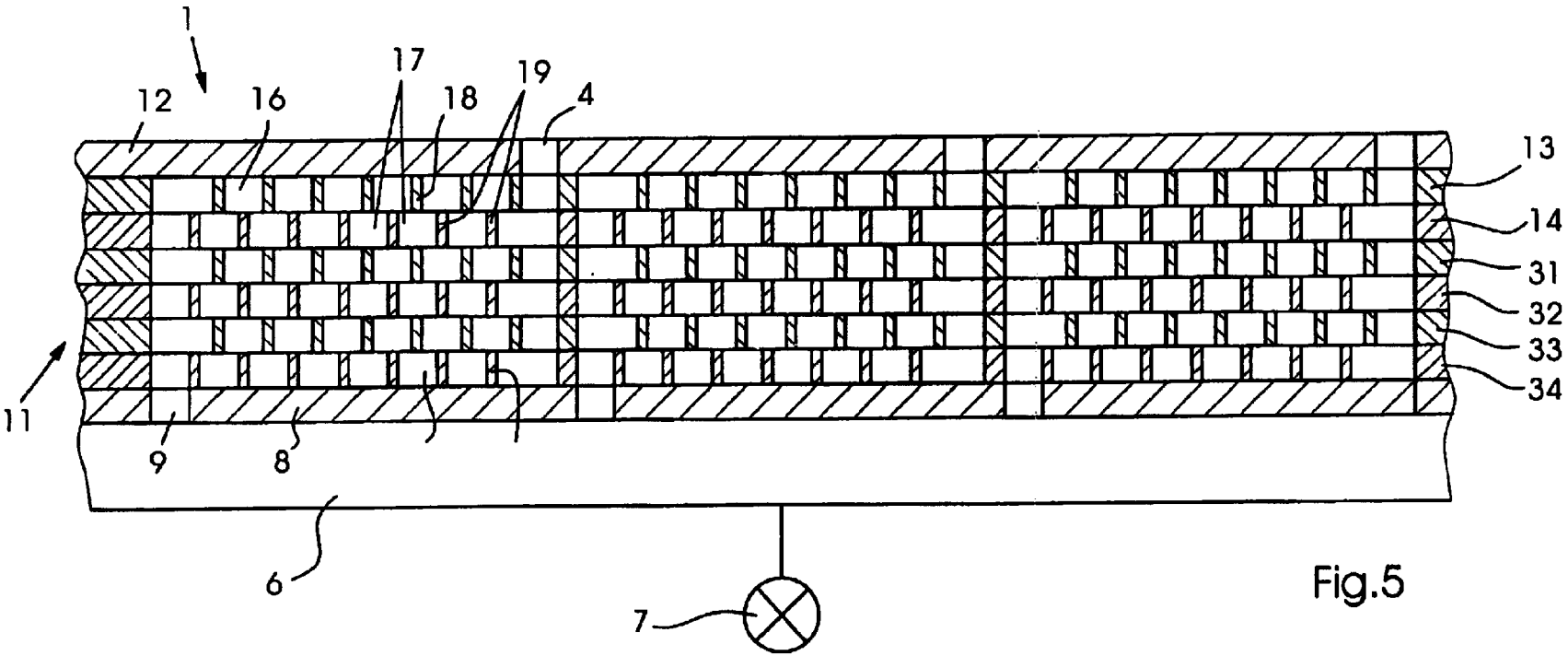
FIG. 5 is a view similar to FIGS. 1A–4 showing a fifth exemplary embodiment of the device according to the invention.

In a fifth exemplary embodiment according to FIG. 5, provision is made for a number of layers 13, 14, 31 to 34, for example six layers, which are constructed in a manner corresponding to that of the layers 13 and 14. By this measure, a large number of air vortices are formed between inlet and outlet openings 9 and 4, respectively.

Figure 6:
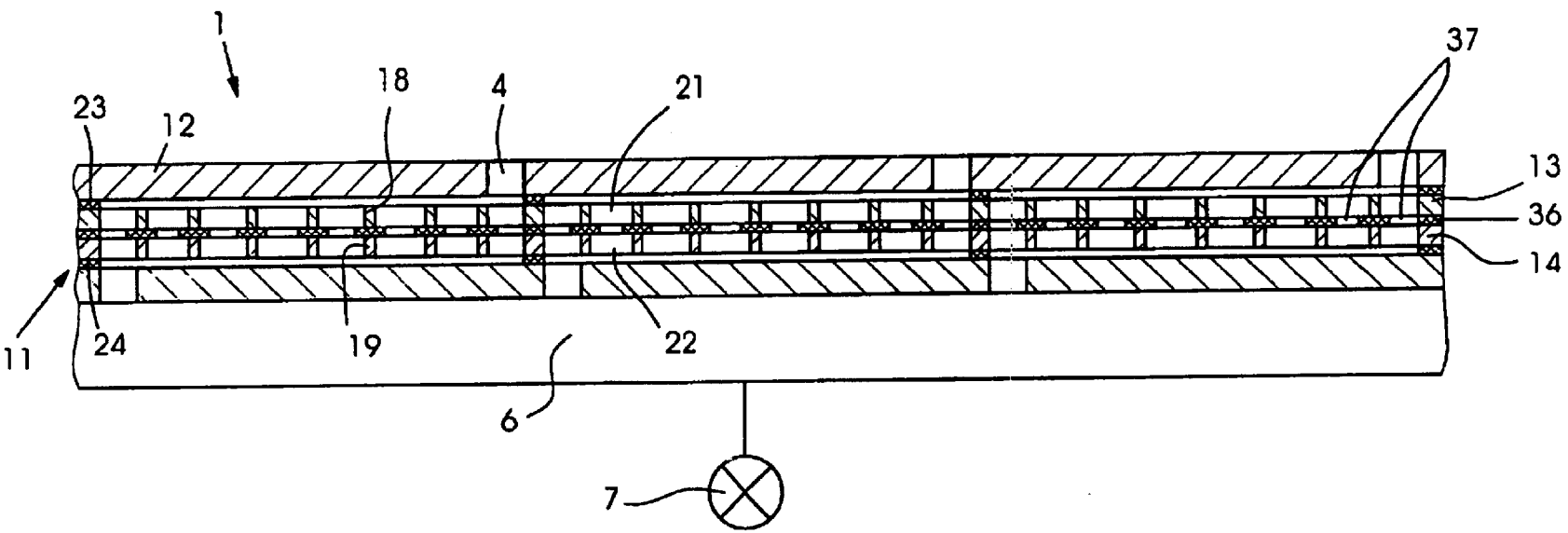
FIG. 6 is a view similar to FIGS. 1A–5 of a sixth exemplary embodiment of the device according to the invention.

In a sixth exemplary embodiment according to FIG. 6, provision is made for further developing the third exemplary embodiment in that, between the layers 13 and 14, there is additionally provided a further layer 36 having a number of openings 37 which correspond to the number of openings 21 and 22 in the layers 13 and 14, the openings 37 having a smaller passthrough width than the openings 21 and 22. In this exemplary embodiment, the openings 21 and 22 are disposed in alignment with one another.

We claim:

1. A supporting or guiding device for sheets in a sheet processing machine, comprising:

a supporting or guiding layer having a supporting or guiding surface formed with a plurality of outlet openings for applying a throttled air flow through said outlet openings to a respective sheet;

a covering plate spaced away from said supporting or guiding surface, said covering plate having a plurality of inlet openings formed therein communicating with at least one blast air source; and at least two intermediate layers disposed between said supporting or guiding surface and said covering plate, each of said intermediate layers having a plurality of openings formed therein;

one of said openings in one of said intermediate layers communicating with two of said openings in the other of said intermediate layers, and one of said openings in the other of said intermediate layers communicating with two of said openings in said one of said intermediate layers, between a respective one of said inlet openings and a respective one of said outlet openings.

2. The supporting or guiding device according to claim 1, further comprising a further layer disposed between said one intermediate layer and said other intermediate layer.

3. The supporting or guiding device according to claim 2, wherein said further layer is formed with openings disposed in a region of a throttle segment located between said respective inlet opening and said respective outlet opening.

* * * * *